US008267174B2

(12) United States Patent
Rogers et al.

(10) Patent No.: US 8,267,174 B2
(45) Date of Patent: Sep. 18, 2012

(54) INTERNAL RETENTION MECHANISM

(75) Inventors: Henry E. Rogers, Duncan, OK (US); Steve L. Holden, Duncan, OK (US); David D. Szarka, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 343 days.

(21) Appl. No.: 12/544,554

(22) Filed: Aug. 20, 2009

(65) Prior Publication Data

US 2011/0042068 A1 Feb. 24, 2011

(51) Int. Cl.
*E21B 23/00* (2006.01)
*E21B 33/00* (2006.01)

(52) U.S. Cl. ..... 166/285; 166/154; 166/332.1

(58) Field of Classification Search ..... 166/285, 166/154, 212, 332.1, 177.4, 289
See application file for complete search history.

(56) References Cited

U.S. PATENT DOCUMENTS

| | | | | |
|---|---|---|---|---|
| 2,925,865 | A | 2/1960 | Oliver | |
| 3,211,232 | A * | 10/1965 | Grimmer | 166/194 |
| 3,768,556 | A | 10/1973 | Baker | |
| 4,479,545 | A | 10/1984 | Eley | |
| 4,669,541 | A | 6/1987 | Bissonnette | |
| 4,880,058 | A | 11/1989 | Lindsey et al. | |
| 5,038,862 | A | 8/1991 | Giroux et al. | |
| 5,044,444 | A | 9/1991 | Coronado | |
| 5,109,925 | A | 5/1992 | Stepp et al. | |
| 5,178,216 | A | 1/1993 | Giroux et al. | |
| 5,277,253 | A | 1/1994 | Giroux et al. | |
| 5,279,370 | A | 1/1994 | Brandell et al. | |
| 5,314,015 | A | 5/1994 | Streich et al. | |
| 5,526,878 | A | 6/1996 | Duell et al. | |
| 5,641,021 | A | 6/1997 | Murray et al. | |
| 6,622,798 | B1 | 9/2003 | Rogers et al. | |
| 6,651,743 | B2 | 11/2003 | Szarka | |
| 6,923,255 | B2 * | 8/2005 | Lee | 166/154 |
| 7,086,479 | B2 | 8/2006 | Schultz et al. | |
| 2010/0051276 | A1 | 3/2010 | Rogers et al. | |
| 2010/0206572 | A1 | 8/2010 | Makowiecki et al. | |

OTHER PUBLICATIONS

International Search Report and The Written Opinion of the International Searching Authority dated Dec. 6, 2010, in corresponding PCT Application No. PCT/GB2010/001570.
Weatherford International Ltd., Houston, TX, Flyer titled "POST (TM) Pack-Off Stage Tool" (2008).
Halliburton Company Sales and Service Catalog, pp. 42 and 43 (1964).
Images from Halliburton Sales Manual (5 sheets) (undated but admitted to be prior art).
International Search Report and Written Opinion of the International Searching Authority dated Aug. 20, 2010, in PCT Application No. PCT/GB2010/000257.

* cited by examiner

*Primary Examiner* — Brad Harcourt
(74) *Attorney, Agent, or Firm* — John W. Wustenberg; McAfee & Taft

(57) ABSTRACT

An anchoring device for stopping movement of a sliding component in a mandrel or case is disclosed. The anchoring device includes an elastically deformable anchor seat and an elastically deformable anchor retainer insertable into the anchor seat. The anchor seat has a groove profile thereon which will mate with a groove profile on the mandrel in an anchoring position. The retainer is insertable into the anchor seat and will hold the anchor seat in the anchoring position.

27 Claims, 6 Drawing Sheets

INTERNAL RETENTION MECHANISM

When wellbores are prepared for oil and gas production it is common to cement casing in the wellbore. Oftentimes it is desirable to cement the casing in the wellbore in separate stages, typically beginning at the bottom of the well and working upwardly.

The process may be achieved by placing cementing tools, such as for example valved ports in the casing or between casing joints at one or more locations in the wellbore. Cement may be flowed through the bottom of the casing, up the annulus to the lowest cementing tool. Flow to the bottom of the casing can then be shut off. The cementing tool is opened and cement may be flowed through the cementing tool up the annulus to the next upper cementing tool. The process may be repeated until all stages of the well are cemented. Cementing tools are shown for example in U.S. Pat. Nos. 5,038,862 and 5,314,015. The '015 patent discloses a stage cementing tool which utilizes an inflatable packer apparatus. U.S. Pat. No. 5,526,878 (the '878 patent) also discloses a stage cementing tool with an inflatable packer apparatus and an internal sliding opening sleeve. The opening sleeve is detachably connected in the mandrel of the tool to cover the cementing ports through which cement passes into the well annulus between the casing and the wellbore. At the appropriate time, the opening sleeve is detached, and moved to uncover the cementing ports. An anchor ring is utilized in the tool to stop the movement of the sliding opening sleeve. The anchor ring is intended to hold the opening sleeve and a cementing plug in the tool while cement is pumped into the annulus. If the anchor ring moves, or falls through the tool, cement can be lost, and the integrity of the cementing job may be compromised. While the anchor ring in the '878 patent works well, there is a continuing need for retention mechanisms that can be easily manufactured and installed, and that will not move during cementing jobs, or when pressure is applied thereto as a result of activities preformed in the well.

SUMMARY

The current disclosure is directed to an anchor ring, or anchoring device for preventing the axial movement in at least one direction of a component moving in a mandrel. In the described embodiment, the anchoring device is positioned in the mandrel to stop the movement of a sliding sleeve. The anchoring device includes a flexible anchor seat insertable into an anchoring position in the mandrel, and a deformable retainer insertable into the anchor seat to hold the flexible anchor seat in the anchoring position. The flexible anchor seat will deform radially inwardly as it is inserted into the mandrel and when it reaches the anchoring position will expand radially outwardly preferably to its relaxed condition. The mandrel has a groove profile thereon that will mate with an anchor seat groove profile defined on the outer surface of the anchor seat. The retainer may be inserted through the mandrel into the anchor seat. The retainer will deform radially inwardly as it is inserted into a fully inserted position in the anchor seat at which point it will expand radially outwardly and will help to hold the flexible anchor seat in the anchoring position. In the described embodiment, the anchoring device is utilized with a stage cementing tool for the purpose of stopping the movement of an opening sleeve that is detachably connected in the mandrel in a closed position. The opening sleeve is detached and moves downward to uncover cementing ports in the mandrel through which cement is displaced to cement casing in a well.

BRIEF DESCRIPTION OF THE DRAWINGS

FIG. 6 is a partial cross-section taken along lines 6-6 in FIG. 2A.

DESCRIPTION OF A PREFERRED EMBODIMENT

Figure 2A:
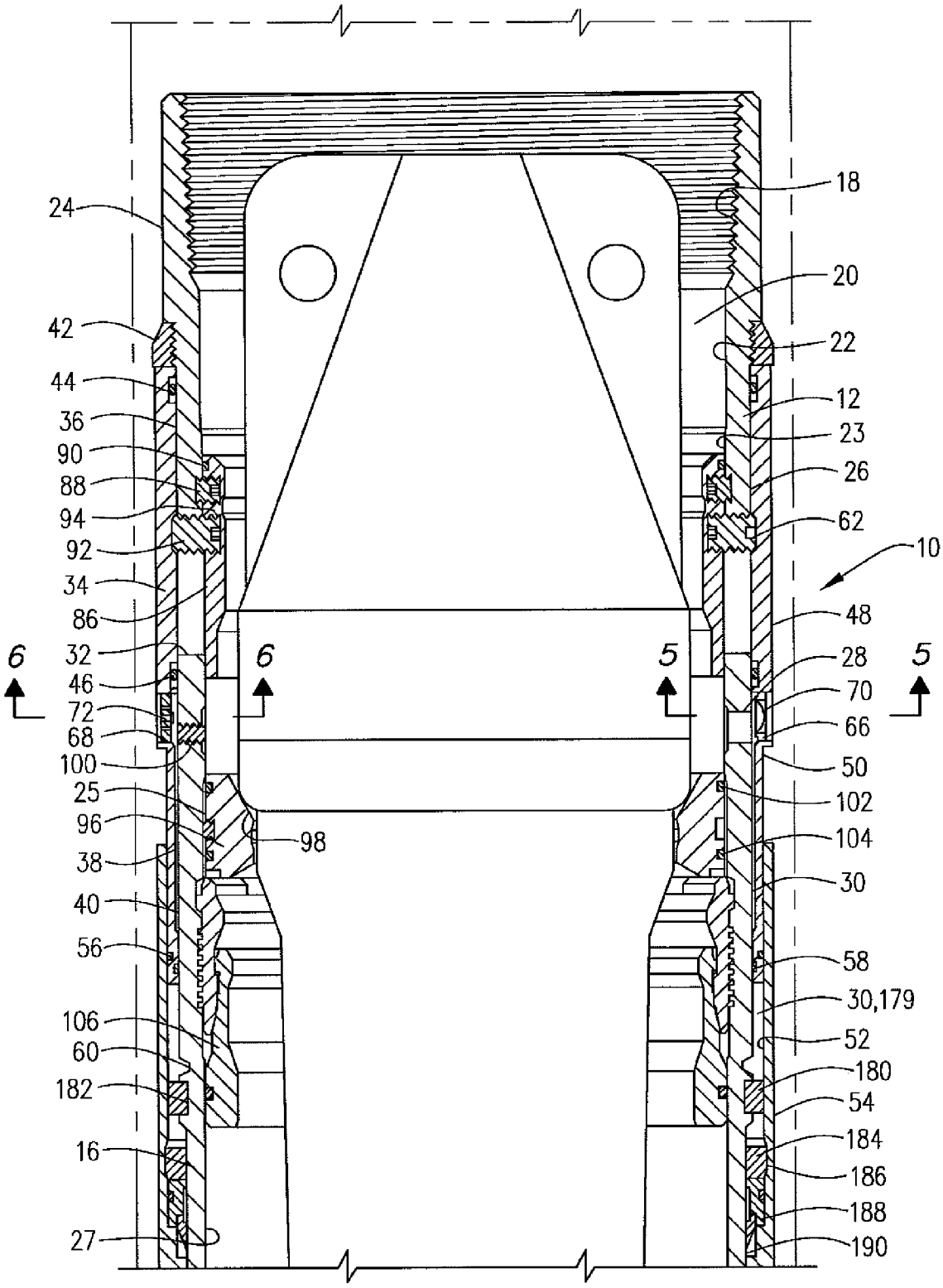
FIGS. 2A and 2B show a longitudinal cross-section view of the stage cementer mechanism of the present invention.
Figure 2B:
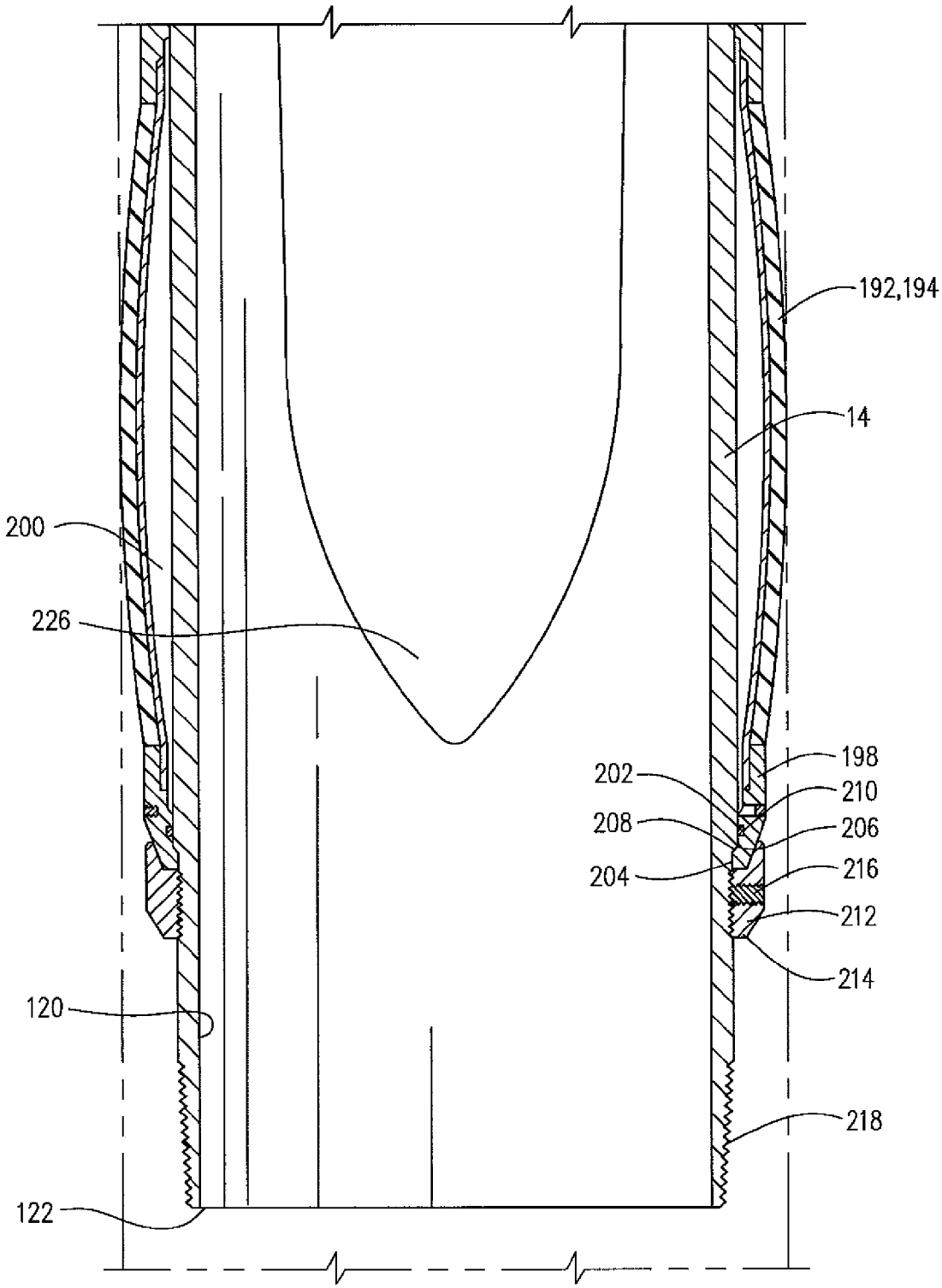

Referring now to the drawings, and more particularly to FIGS. 2A and 2B, a stage cementing tool with a retention mechanism, or anchor ring, is shown and generally designated by the numeral 10. Cementing tool 10 which may be referred to as apparatus 10 generally comprises an upper cementer portion 12 and a lower packer portion 14.

Apparatus 10 includes a substantially tubular mandrel 16 which extends through both cementer portion 12 and packer portion 14. Mandrel 16 has an internally threaded surface 18 at the upper end thereof adapted for connection to a casing string. Mandrel 16 defines an inner passage or longitudinal central flow passage 20 therein, at least partially defined by a first bore 22 and a slightly smaller second bore 23. Mandrel 16 also defines a third bore 25 that is larger than second bore 23, and a fourth bore 27.

Mandrel 16 has a first outer surface 24 and a slightly smaller second outer surface 26 below the first outer surface. At least one transversely disposed mandrel port 28 which may be referred to as a cementing port 28 is defined through the wall of mandrel 16. As will be further discussed herein, mandrel port 28 is used as an inflation port for communicating inflation fluid to an inflation fluid passageway 30 and as a cementing port. Inflation passageway 30 provides communication between inner passage 20 in mandrel 16 and packer portion 14.

Also defined in mandrel 16 are a plurality of longitudinally extending slots 32. Slots 32 are preferably disposed above mandrel port 28.

Apparatus 10 includes an outer, external closing or closure sleeve 34 having a first bore 36 which is concentrically, closely, slidably received about second outer surface 26 of mandrel 16. Closure sleeve 34 also has a slightly larger second bore 38 therein such that an annulus 40 is defined between second bore 38 and second outer surface 26 of mandrel 16. As will be further described herein, annulus 40 also forms a portion of inflation passageway 30.

Closure sleeve 34 is movable relative to mandrel 16 between an open position, as seen in FIG. 2A and a closed position wherein mandrel port 28 is covered and closed by the closure sleeve.

A support ring 42 is threadingly engaged with mandrel 16 above closure sleeve 34 and acts as an upper stop for the closure sleeve.

A sealing means, such as an upper seal 44 and a lower seal 46, provides sealing engagement between closure sleeve 34 and second outer surface 26 of mandrel 16. Upper seal 44 is always positioned above slots 32. In the open position shown in FIG. 2B, lower seal 46 is disposed between slots 32 and mandrel port 28.

Closure sleeve 34 has a first outer surface 48 and a smaller second outer surface 50 below the first outer surface. At least a portion of second outer surface 50 is slidably received within first bore 52 defined in an upper packer shoe 54 of packer portion 14. Thus, upper packer shoe 54 of packer portion 14 acts as a housing for slidably receiving the lower end of closure sleeve 34 of cementer portion 12, and it may be said that cementer portion 12 and packer portion 14 overlap.

A sealing means, such as O-ring 56, provides sealing engagement between closure sleeve 34 and upper packer shoe 54.

A lock ring 58 is carried by the lower end of closure sleeve 34 below O-ring 56. Lock ring 58 is adapted for lockingly engaging an undercut groove 60 on mandrel 16 so that, when closure sleeve 34 is moved to its closed position, lock ring 58 will lock the closure sleeve in this position.

An annular groove 62 is defined in closure sleeve 34 and generally faces inwardly toward slots 32.

Closure sleeve 34 also defines a transversely disposed first threaded sleeve port 66 and a second threaded sleeve port 68. First threaded sleeve port 66 is in communication with mandrel port 28, and as will be further described herein, acts as a pressure relief in cementing the port. First and second sleeve ports 66 and 68 will be seen to be in communication with annulus 40. A pressure relief device 70 is threadingly engaged with first sleeve port 66, and a pressure equalizing device 72 is threadingly engaged with second sleeve port 68.

Figure 5:
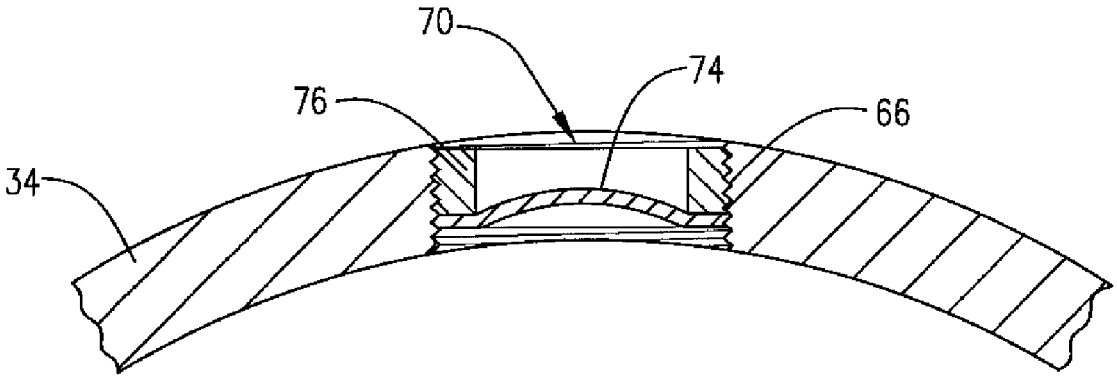
FIG. 5 is a partial cross-section taken along lines 5-5 in FIG. 2A.
Figure 5:
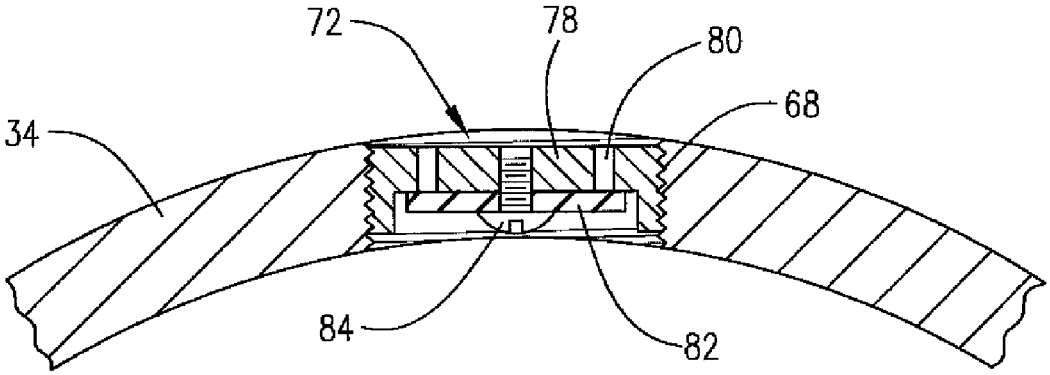

Referring now to FIG. 5, a preferred embodiment of pressure relief device 70 is illustrated as a rupture disc 74 which is attached to a rupture disc retainer 76 by means such as braising or welding. Rupture disc retainer 76 is threaded into first sleeve port 66.

Referring now to FIG. 6, pressure equalizing device 72 may be a back check valve assembly 72. Back check valve assembly 72 includes a valve seat 78 which has a plurality of openings 80 defined therethrough and is threadingly engaged with second sleeve port 68. A flexible valve member 82 is attached to the inside of valve seat 78 by a fastening means, such as a screw 84. It will be seen by those skilled in the art that due to the flexibility of valve member 82, fluid may flow inwardly through valve equalizing means 72 but outward flow is prevented. This prevents an undesired pressure differential across rupture disc 74 in pressure relief means 70 as the tool is run into the wellbore. That is, pressure equalizing means 72 insures that the pressure on both sides of rupture disc 74 is equalized and rupture disc 74 will not be ruptured inwardly by pressure from the wellbore.

Referring again to FIG. 2A, apparatus 10 includes an inner operating sleeve 86 which is slidably received in second bore 23 in mandrel 16. Operating sleeve 86 is slidable between the first position relative to mandrel 16, as seen in FIG. 2A, and a second position corresponding to the closed position of closure sleeve 34, as will be further described herein.

A plurality of shear pins 88 initially hold operating sleeve 86 in its first position. A sealing means, such as O-ring 90, provides sealing engagement between operating sleeve 86 and mandrel 16.

A plurality of pins 92 extend through slots 32 in mandrel 16 and are fixably connected to operating sleeve 86 and closure sleeve 34 for common longitudinal movement relative to mandrel 16 throughout the entire movement of operating sleeve 86 from its first position to its second position. Since pins 92 fixedly connect operating sleeve 86 to closure sleeve 34, there is no lost longitudinal motion of operating sleeve 86 relative to closure sleeve 34 as the operating sleeve moves downwardly to close mandrel port 28 with closure sleeve 34.

Each pin 92 is threadingly engaged with a threaded opening 94 in operating sleeve 86 and extends through slot 32 in mandrel 16 to tightly engage groove 62 in closure sleeve 34.

Pins 92 and their engagement with operating sleeve 86 and closure sleeve 34 may all be referred to as an interlocking means, and more particularly to a mechanical means, extending through slots 32 and operably associated with both the operating sleeve and the closure sleeve for transferring a closing force from the operating sleeve to the closure sleeve, and thereby moving closure sleeve 34 to its closed position as operating sleeve 86 moves from its first position and its second position.

Pins 92 also serve to hold operating sleeve 86 so that it will not rotate as operating sleeve 86 is later drilled out of mandrel 16 after the cementing job is completed.

Figure 4:
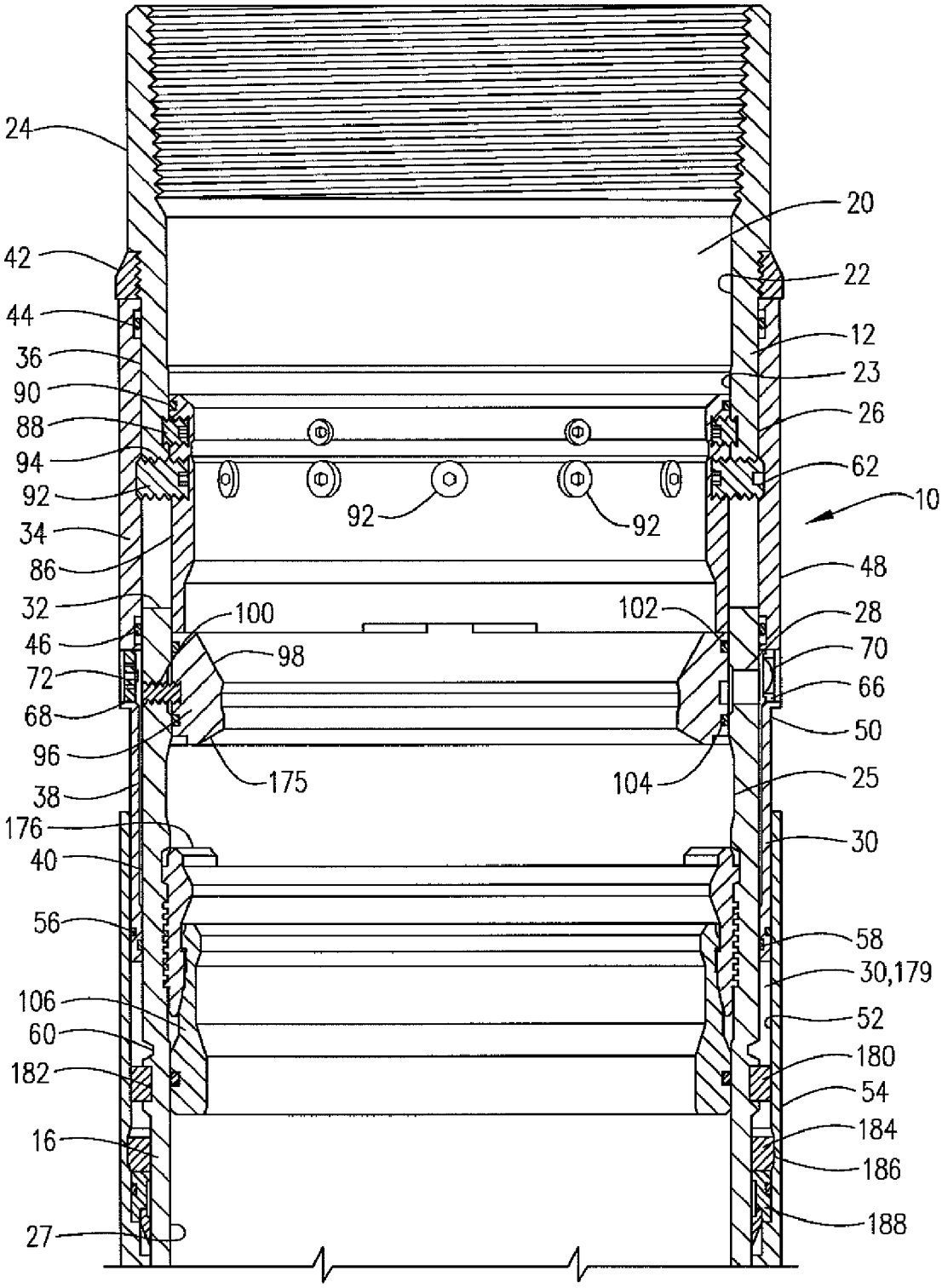
FIG. 4 shows the tool of FIG. 2 with the stage cementing sleeve in the closed position.

Apparatus 10 further includes an internal lower opening sleeve 96 slidably received in second bore 23 of mandrel 16 below operating sleeve 86. Opening sleeve 96 is slidable from the closed position shown in FIG. 4 covering mandrel port 28 and an open position shown in FIG. 2A wherein mandrel port 28 is uncovered by opening sleeve 96 as the opening sleeve moves downwardly relative to mandrel 16. It is noted that when opening sleeve 96 is in its closed position as shown in FIG. 4, operating sleeve 86 is simultaneously in its first position, and inner passage 20 of mandrel 16 is in fluid pressure communication with bore 36 of closure sleeve 34 between seals 44 and 46. This is because there is no seal between the lower end of operating sleeve 86 and mandrel 16.

As shown in FIG. 2A and FIG. 4, opening sleeve 96 is a plug operated sleeve having an annular seat 98 defined on its upper end which is constructed for engagement by a pump-down or free-fall plug of a kind known in the art. A plurality of shear pins 100 initially hold opening sleeve 96 in its closed position. A sealing means, such as upper and lower O-rings 102 and 104, provides sealing engagement between opening sleeve 96 and bore 23 of mandrel 16 above and below mandrel port 28, respectively, when the opening sleeve is in its closed position.

An anchor ring or internal retention mechanism 106 is disposed in fourth bore 27 of mandrel 16 and is spaced below opening sleeve 96 when the opening sleeve is in its closed position. Anchor ring 106 may also be referred to as an anchoring device. While opening sleeve 96 is depicted as a plug operated opening sleeve, it is understood that the opening sleeve could comprise a hydraulically operated opening sleeve.

Figure 3:
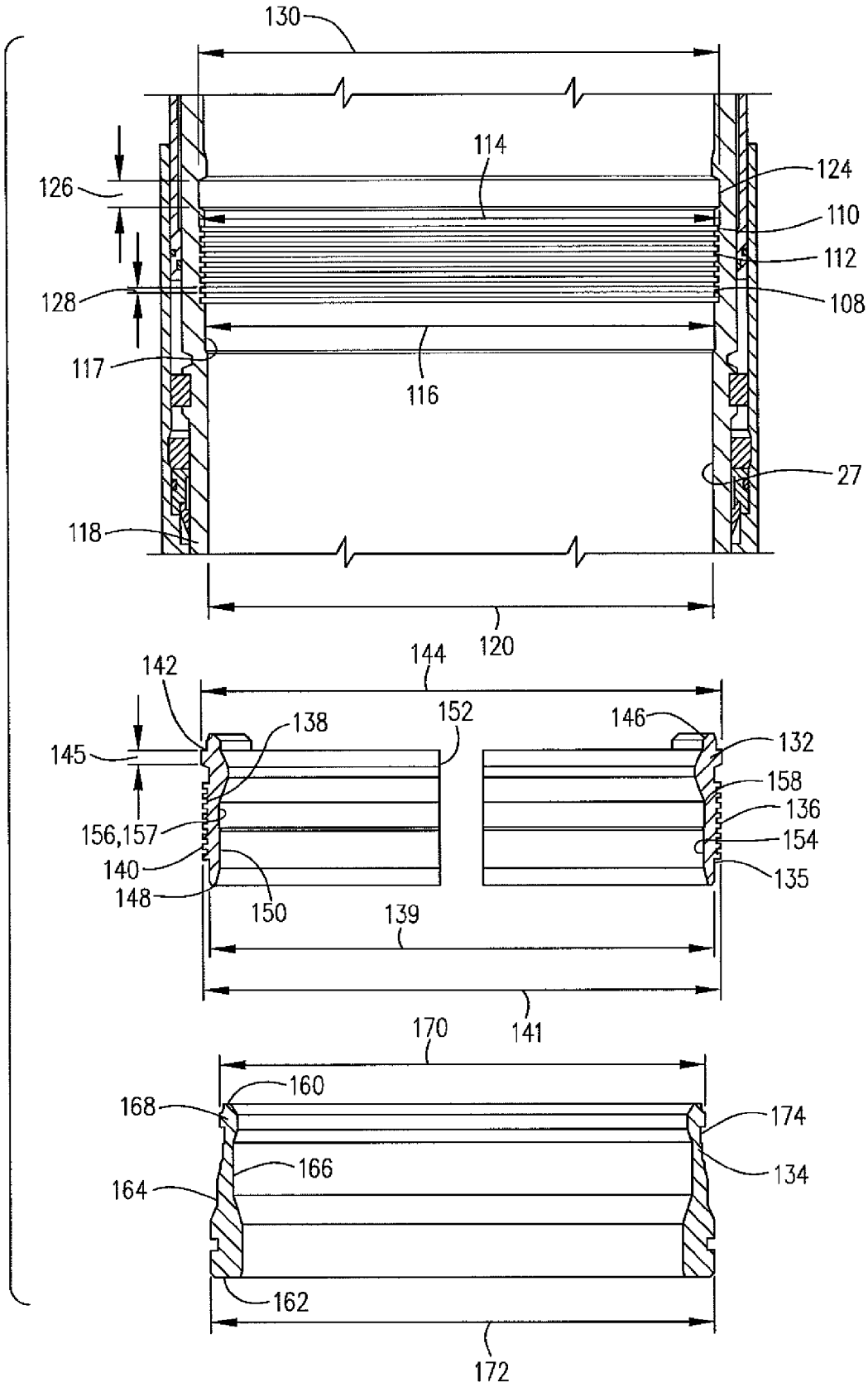
FIG. 3 is an exploded view of a portion of the mandrel, and the retention mechanism of FIG. 2.

Referring now to FIGS. 3 and 4, the portion of mandrel 16 into which the anchor ring 106 is inserted is shown. As depicted therein, mandrel 16 has a mandrel groove profile 108 defined therein on an inner surface thereof and in the embodiment shown defined on bore 27. Mandrel groove profile 108 includes a plurality of mandrel grooves 110 defining a plurality of mandrel crowns 112 therebetween. Preferably, grooves 110 are square grooves. Mandrel grooves 110 define a mandrel groove diameter 114 while mandrel crowns 112 define a mandrel crown diameter 116. Undercut portion 117, shown in the drawings having diameter 116 as well, may have a slightly smaller diameter than crown diameter 116.

Mandrel 16 further comprises an entry portion 118. Entry portion 118 is that portion of the mandrel through which anchor ring 106 is inserted into an anchoring position which will be discussed in more detail hereinbelow. Entry portion 118 defines an entry diameter 120. Entry diameter 120 will be smaller than an outermost diameter of anchor ring 106, and may be, for example, an innermost diameter between an insertion end 122 of mandrel 16 through which anchor ring 106 is inserted to the anchoring position shown in FIG. 2A and FIG. 4.

A latching groove 124 is defined in mandrel 16. Latching groove 124 has a width 126 that is wider than a width 128 of mandrel grooves 110. Latching groove 124 has a latching groove diameter 130. Latching groove diameter 130 is slightly greater than mandrel groove diameter 114.

Referring to FIG. 3, anchor ring 106 which is also referred to as retention mechanism 106 may comprise an anchor seat 132 and an anchor seat retainer 134. Anchor seat 132 is preferably a flexible or deformable anchor seat 132. Anchor seat 132 is shown in a relaxed or natural condition in FIG. 3 in which it is not deformed. As will be explained in more detail, anchor seat 132 will deform or flex as it is inserted into mandrel 16 to the anchoring position shown in FIG. 2A. Anchor seat 132 has an outer surface 135 with a groove profile 136 defined thereon. Groove profile 136 includes a plurality of anchor grooves 138 having an outer anchor groove diameter 139. Anchor grooves 138 define a plurality of crowns or anchor crowns 140 therebetween with an anchor seat crown diameter 141. A latching head 142 with an outer latching head diameter 144 is defined at or near a first end 146 of anchor seat 132. Latching head diameter 144 is slightly greater than the anchor seat crown diameter 141. Latching head diameter 144 has a width 145. Anchor seat 132 likewise has a second or lower end 148 and an inner surface 150. A slot 152 extends through the wall of anchor seat 132 from the upper end 146 to the lower end 148 thereof. Inner surface 150 defines a first internal diameter 154 and a second internal diameter 156. Second internal or inner diameter 156 comprises a receiving groove or receptacle 157. Receptacle 157 has an upper end 158. Inner surface 150 slopes radially inwardly from upper end 158 of receptacle 157.

Anchor seat retainer 134 has first or upper end 160, second or lower end 162, outer surface 164 and inner surface 166. Anchor seat retainer 134 is a deformable or flexible anchor seat retainer as will be explained in more detail hereinbelow. Anchor seat retainer 134 has retainer head 168 at the first end or leading edge thereof and defines a first outer diameter, or outer retainer head diameter 170. Anchor seat retainer 134 has a second outer diameter 172 which may be described as the outermost diameter 172 of anchor seat retainer 134. Outermost diameter 172 will engage the inner surface of mandrel 16 as described in more detail hereinbelow. A groove 174 is defined on outer surface 164 immediately below retainer head 168.

The assembly and installation of the retention mechanism 106 may be explained as follows. FIG. 3 shows anchor seat 132, which may be referred to as split ring anchor seat 132, in the relaxed or natural condition. In the relaxed condition latching head outer diameter 144 and anchor seat crown diameter 141 have a magnitude greater than entry diameter 120. As such, to be inserted into the anchoring position, anchor seat 132 must be flexed or deformed radially inwardly to be pushed through mandrel 16 into the anchoring position. In the anchoring position, anchor seat groove profile 136 mates with mandrel groove profile 108. Anchor seat 132 will expand when it reaches the anchoring position. Because the width 145 of latching head 142 is greater than the width 128 of grooves 110, anchor seat 132 will move over mandrel groove profile 108 until latching head 142 reaches latching groove 124 at which point anchor seat 132 will then radially expand at least partway and preferably all the way to its natural or relaxed condition. Anchor seat groove profile 136 will then mate with the mandrel groove profile 108. In other words, anchor seat groove crowns 140 will be received in mandrel grooves 110.

Anchor seat retainer 134 is inserted through entry diameter 120 as well. Anchor seat retainer 134 is inserted through mandrel 16 and preferably will slidably pass through entry diameter 120. Anchor seat retainer 134 will elastically deform radially inwardly as it is inserted into inner surface 150 of anchor seat 132. Anchor seat retainer 134 will be inserted until retainer head 168 reaches second internal diameter 156 of anchor seat 132 at which point retainer head 168 will expand radially outwardly into second inner diameter 156 which acts as a latching or seating receptacle for retainer head 168. In this position, anchor seat retainer 134 is essentially locked in place and prevented from axial movement. Anchor seat retainer 134 will preferably be in its relaxed or fully expanded condition when fully inserted into anchor seat 132. When opening sleeve 96 is moved to its open position it will move downwardly until it abuts anchor seat 132. A lower end 175 of opening sleeve 96 acts as a lug which is received within an upwardly faced recess 176 on anchor seat 132 when the opening sleeve is moved to its open position. This prevents opening sleeve 96 from rotating relative to anchor ring 106 in mandrel 16 at a later time when the internal components are drilled out of mandrel 16. Similarly, a lug on the upper end of opening sleeve 96 is received within a downwardly facing recess on the lower end of operating sleeve 86 when the opening sleeve is in its open position and the operating sleeve is moved to its second position. This prevents operating sleeve 86 from rotating relative to opening sleeve 96 in mandrel 16 at a later time when the internal components are drilled out of the mandrel.

Below lock ring 58, mandrel 16 and upper packer shoe 54 define an annular passageway 179 therebetween which will be seen to be part of inflation passageway means 30. A stop ring 180 is disposed in annular passageway 179 and is engaged with a groove 182 on the outer surface of mandrel 16. Stop ring 180 is an inwardly biased retainer ring and is adapted for sliding engagement within first bore 52 of upper packer shoe 54 as the upper packer shoe moves downwardly as hereinafter described. Fluid is free to flow downwardly through annular passageway 179 past stop ring 180.

A check valve retainer ring 184 is disposed in annular passageway 179 and is engaged with a groove 186 on the inside of upper packer shoe 54. Check valve retainer ring 184 is a radially outwardly biased retainer ring and is adapted to allow fluid flow therepast through annular passageway 179.

A check valve 188 is disposed in annular passageway 179 adjacent to check valve retainer ring 184. Check valve 188 sealingly engages outer surface 190 of mandrel 16. Check valve 188 is of a kind known in the art and allows fluid flow downwardly through annular passageway 179 while preventing upward fluid flow.

Referring now to FIG. 2B, packer portion 14 of apparatus 10 further comprises a metal bladder packer 192 which includes an outer, elastomeric sealing element 194 and an inner, metal element 196. Sealing element 194 and metal element 196 are attached at their upper ends to upper packer shoe 54 in a manner known in the art and at their lower ends to a lower packer shoe 198. An annulus 200 is defined between metal element 196 and outer surface 190 of mandrel 16. Annulus 200 forms a portion of inflation passageway means 30.

Lower packer shoe 198 has a first bore 202 therein which generally faces outer surface 190 of mandrel 16 and a smaller second bore 204 which faces another, smaller outer surface 206 of mandrel 16. Upward movement of lower packer shoe 198 with respect to mandrel 16 is prevented by a shoulder 208 on the mandrel which extends between outer surfaces 190 and 206.

A sealing means, such as O-ring 210, provides sealing engagement between lower packer shoe 198 and mandrel 16.

A packer backup ring 212 is attached to mandrel 16 at threaded connection 214. Backup ring 212 is adapted to engage lower packer shoe 198 and prevent downward movement thereof with respect to mandrel 16. A set screw 216 prevents undesired rotation of backup ring 212.

Below packer portion 14, mandrel 16 has a threaded outer surface 218 which is adapted for connection to casing string below apparatus 10 as desired.

OPERATION OF THE APPARATUS

Figure 1:
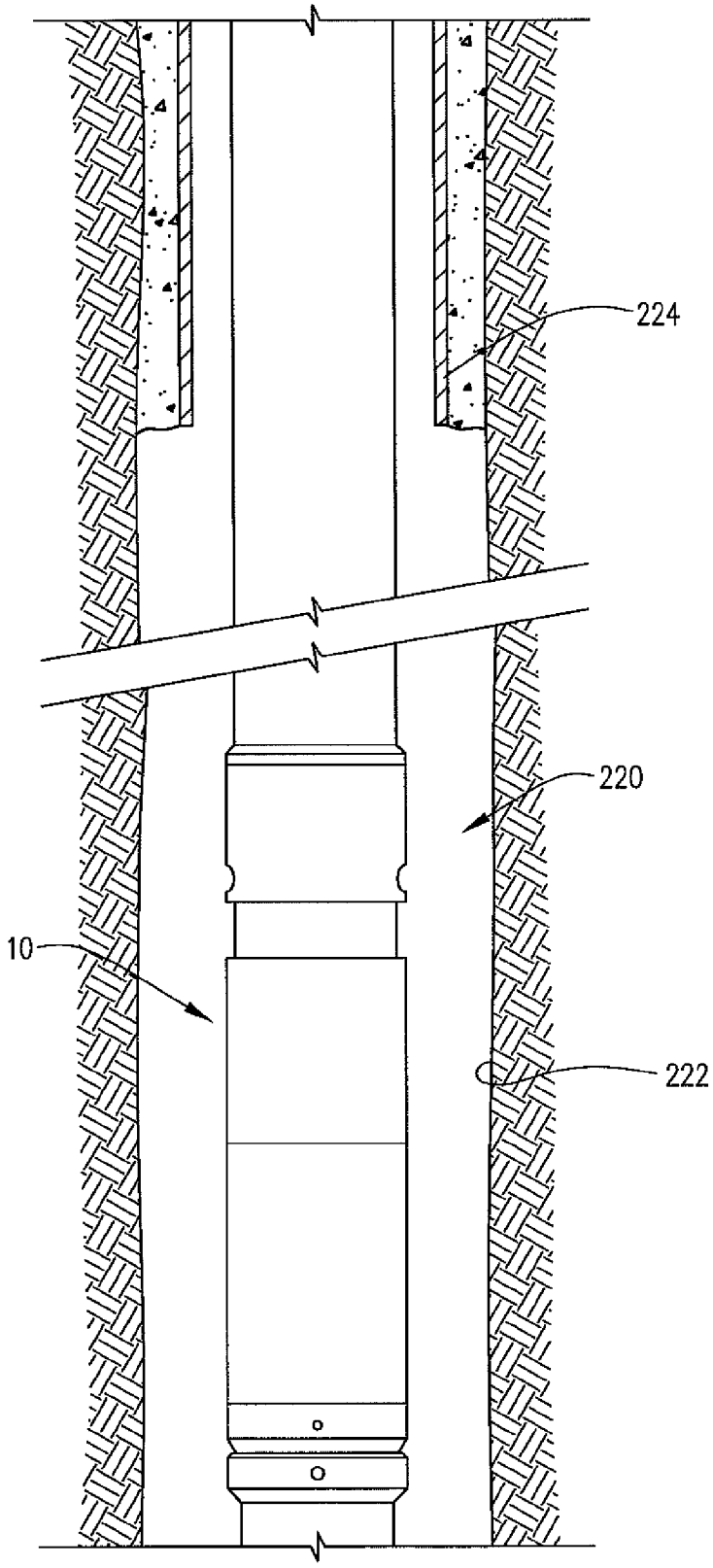
FIG. 1 schematically shows a stage cementing tool in a well.

Cementing tool 10 is made up as part of the casing string which is run into the wellbore in a manner known in the art. FIG. 1 shows cementing tool 10 lowered into a well 220, comprising wellbore 222, which may have casing 224 cemented in a portion thereof. FIG. 4 shows cementing tool 10 in the closed position, in which it is lowered into the well. Cementing tool 10 is in the configuration shown in FIGS. 2A and 2B when a cementing plug 226 has engaged opening sleeve 96 and moved it to the open position.

As cementing tool 10 is run into the wellbore, the pressure in the well annulus and the pressure in annulus 40 in the tool is equalized through pressure equalizing device 72. Fluid in the wellbore will pass through openings 80 in valve body 78 and deflect valve member 82 inwardly. This prevents premature inward rupturing of rupture disc 74.

Cementing of the first or bottom stage below apparatus 10 is carried out in a manner known in the art. This places cement between the casing and the wellbore at a location below cementing tool 10.

After the first stage cementing operation is completed, opening sleeve 96 is actuated. This is accomplished by dropping into the casing pump-down or free-fall cementing plug 226, which is known in the art. Cementing plug 226 engages annular seat 98 on opening sleeve 96.

Pressure is then applied to the casing which forces the opening plug against opening sleeve 96, thereby shearing shear pins 100 and moving opening sleeve 96 downwardly from its closed position until it contacts anchor ring 106. Opening sleeve 96 is shown in FIG. 2A in the open position, engaging anchor seat 132 of anchor ring 106. This places opening sleeve 96 in its open position, and as will be seen by those skilled in the art, mandrel port 28 is thus opened and placed in communication with inner passage 20 in mandrel 16. Anchor seat retainer 134 will prevent anchor seat 132 from moving out of the anchoring position, and will not let anchor seat 132 deform radially and move in mandrel 16.

As casing pressure is increased, fluid passes through inflation passageway 30 to inflatable packer portion 14. That is, fluid passes from inner passage 20 through mandrel port 28 into annulus 40, then through annular passageway 179 to check valve 188. The fluid flows past check valve 188 into annulus 200 inside packer portion 14. Check valve 188 insures that there is no back flow out of inflatable packer portion 14. As bladder 192 inflates, upper packer shoe 54 slides downwardly with respect to closing sleeve 34 and mandrel 16, allowing sealing element 194 to be brought into sealing engagement with the wellbore.

When pressure in the casing, and thus in inner passage 20 and inflation passageway device 30, reaches a predetermined level, rupture disc 74 of pressure relief device 70 will rupture outwardly. It will be seen that this places first sleeve port 66 in closure sleeve 34 and mandrel port 28 in communication with the well annulus. Then cement for the second stage cementing can be pumped down the casing with the displacing fluids located therebelow being circulated through aligned ports 28 and 66 and back up the well annulus. A bottom cementing plug (not shown) may be run below the cement, and a top cementing plug (not shown) is run at the upper extremity of the cement, in a manner known in the art.

The bottom plug, if any, will seat against operating sleeve 86, and further pressure applied to the cement column will rupture a rapture disc in the bottom cementing plug. The cement will then flow through the bottom cementing plug and through aligned ports 28 and 66 and upwardly through the well annulus.

When the top cementing plug seats against the bottom cementing plug, the second stage of cementing is terminated. Further pressure applied to the casing causes the top and bottom cementing plugs to bear against operating sleeve 86, forcing the operating sleeve downwardly from its first position to its second position and shearing shear pins 88. Because of the mechanical interlocking by pins 92 between operating sleeve 86 and closure sleeve 34, closure sleeve 34 is moved downwardly from its open position to its closed position as operating sleeve 86 is moved downwardly from its first to its second position. As this occurs, lower seal 46 in closure sleeve 34 is moved below mandrel port 28, thus sealingly separating mandrel port 28 from first sleeve port 66. The interaction between lock ring 58 and groove 60 in mandrel 16 locks closure sleeve 34 in the closed position.

It will be seen by those skilled in the art that fluid may then no longer flow through mandrel port 28 and out first sleeve port 66 into the well annulus. Second outer surface 50 on closure sleeve 34 slides downwardly within upper packer shoe 54. Downward movement of operating sleeve 86 and closure sleeve 34 stops when the lower end of operating sleeve 86 engages the top of opening sleeve 96 and the lower end of closure sleeve 34 contacts stop ring 180.

Subsequent to this cementing operation, the upper and lower cementing plugs, operating sleeve 86, opening sleeve 96, and anchor ring 106 can all be drilled out of mandrel 16 having a smooth bore through apparatus 10. The components to be drilled out may be made of easily driftable material, such as, for example, plastic, composites or aluminum.

It is important that retention mechanism 106 stay in the anchoring position shown in FIG. 2A when opening sleeve 96 is opened and cementing operations begin. Movement of retention mechanism 106 out of the anchoring position can cause the cementing job to fail or to cause the integrity of the cementing job to be questioned. It may also cause a loss of cement since movement out of the anchoring position could cause cement to fill inside tool 10 and the casing therebelow. Furthermore, any cement inside the tool or in the casing will have to be drilled out which is a time-consuming and expensive process. While retention mechanism 106 has been described herein with respect to a stage cementing tool, it is understood that retention mechanism 106 can be used in tools with a mandrel or other case to which the mechanism can be attached, and used to stop the movement of a sliding sleeve therein.

While anchor seat 132 has been shown and described as a split ring, it is understood that other configurations, for example, a collet, that are capable of flexing, and can have a groove profile thereon, may be utilized as well. Further while anchoring device 106 is depicted in connection with a stage cementing tool for stopping a sliding sleeve, it may be used to stop other equipment movable in a case, or mandrel. For example, when cementless float equipment is required, anchoring device 106 may be installed in a casing to hold a float collar in place in a casing.

It will be seen therefore, that the retention mechanism of the present invention is well adapted to carry out the ends and advantages mentioned, as well as those inherent therein. While the presently preferred embodiment of the apparatus has been shown for the purposes of this disclosure, numerous changes in the arrangement and construction of parts may be made by those skilled in the art. All of such changes are encompassed within the scope and spirit of the appended claims.

What is claimed is:

1. An anchoring device for preventing the axial movement in at least one direction of a sliding sleeve in a mandrel comprising:

a flexible anchor seat insertable into an anchoring position in the mandrel wherein the flexible anchor seat has a groove profile thereon defining a plurality of grooves and crowns, the mandrel defining a mandrel profile with a plurality of mandrel grooves and crowns, wherein the anchor groove profile mates with the mandrel groove profile in the anchoring position of the flexible anchor seat; and an elastically deformable retainer insertable into the anchor seat to hold the flexible anchor seat in the anchoring position.

2. The anchoring device of claim 1, the flexible anchor seat comprising a slot extending from an upper end to a lower end thereof.

3. The anchoring device of claim 2, wherein the flexible anchor seat has an outer diameter in a relaxed state that is greater than a diameter of a portion of the mandrel through which the anchor seat is inserted to the anchoring position.

4. The anchoring device of claim 2, wherein the elastically deformable retainer deforms upon insertion into the anchor seat and expands radially at least part way to a relaxed state upon full insertion of the retainer into the anchor seat.

5. The anchoring device of claim 2, wherein the flexible anchor seat deforms as it is inserted through the mandrel to its anchoring position, and returns at least partially to its relaxed condition in the anchoring position in the mandrel.

6. The anchoring device of claim 1, an inner diameter of the mandrel between an insertion end thereof and the mandrel groove profile having a magnitude less than a minimum mandrel crown diameter.

7. The anchoring device of claim 1, the flexible anchor seat comprising a latching head at a leading edge thereof, the latching head defining a latching head outer diameter, the mandrel defining a latching receptacle for receiving the latching head, wherein the anchor seat groove profile mates with the mandrel groove profile when the latching head is received in the latching receptacle.

8. The anchoring device of claim 7, the latching receptacle comprising a latching groove defined on an inner surface of the mandrel.

9. The anchoring device of claim 7, the latching head outer diameter of the anchor seat having a magnitude equal to or greater than an anchor seat crown diameter when the anchor seat is in a relaxed condition.

10. A stage cementing tool for cementing a casing in a wellbore comprising:

a mandrel connectable to the casing, the mandrel having a cementing port through a wall thereof and defining a central flow passage therethrough;

an opening sleeve detachably connected in the mandrel and movable from a closed position in which the opening sleeve covers the cementing port to an open position in which the central flow passage is communicated with the cementing port;

an anchor seat positioned at an anchoring position in the mandrel for stopping the movement of the opening sleeve after it has moved from the closed to the open position, the anchor seat having an outer diameter in a relaxed state greater than an entry diameter of the mandrel through which the anchor seat is inserted to the anchoring position in the mandrel; and a retaining ring received in the anchor seat, wherein the retaining ring expands radially outwardly into an inner surface of the anchor seat for holding the anchor seat in the anchoring position.

11. The tool of claim 10, the anchor seat having a plurality of crowns defining a plurality of grooves therebetween on an outer surface thereof, wherein in the anchoring position the crowns in the anchor seat are received in grooves defined in an inner surface of the mandrel.

12. The tool of claim 11, the grooves in the mandrel defining a plurality of mandrel crowns, an entry diameter of the mandrel having a magnitude smaller than a mandrel crown diameter.

13. The tool of claim 11 wherein the retaining ring deforms as it is inserted in the anchor seat and returns to its relaxed condition upon full insertion into the anchor seat.

14. The tool of claim 11, the anchor seat having a latching head at an end thereof, the latching head being receivable in a latching groove in the mandrel, wherein the crowns on the anchor seat are received in the grooves on the mandrel when the latching head is received in the latching groove.

15. The tool of claim 10 further comprising a packer disposed about the mandrel.

16. The tool of claim 15, the packer comprising an inflatable packer, an inflation passageway being defined by the packer and the mandrel, wherein the central flow passage is communicated with the inflation passage through the cementing port when the opening sleeve is in the open position.

17. The tool of claim 10, further comprising a closing sleeve disposed about the mandrel and an operating sleeve detachably connected in the mandrel, the operating sleeve latched to the closing sleeve, wherein the closing sleeve is movable from its initial position in which it does not cover the cementing port to a closed position wherein the closing sleeve covers the cementing port after cementing is complete.

18. The tool of claim 10, the anchor seat comprising a split ring anchor seat with a slot extending from an upper to a lower end thereof.

19. A cementing tool comprising:

a mandrel connectable to a casing, the mandrel defining a central flow passage and having a cementing port therethrough;

a packer attached to the mandrel and movable from an unset to a set position in the well;

an opening sleeve detachably connected in the mandrel in a closed position in the mandrel, the opening sleeve slidable in the mandrel to an open position in which the central flow passage can communicate fluid through the cementing port; and a deformable anchor seat for stopping the movement of the opening sleeve in the mandrel, the anchor seat having an anchor seat groove profile defined on an outer surface thereof wherein the mandrel elastically deforms the anchor seat as the anchor seat is inserted therethrough to an anchoring position in which the anchor seat groove profile will be received in a mandrel groove profile defined on an inner surface of the mandrel.

20. The cementing tool of claim 19, wherein the anchor seat returns to its original relaxed condition in the anchoring position in the mandrel.

21. The tool of claim 19, the anchor seat comprising a split ring anchor seat having a slot therethrough extending from an upper to a lower end thereof.

22. The tool of claim 21, further comprising an anchor seat retainer disposed in the split ring anchor seat.

23. The tool of claim 21, wherein a minimum crown diameter of the mandrel groove profile is greater than a mandrel entry diameter through which the anchor seat passes upon insertion to the anchoring position.

24. The tool of claim 21, the anchor seat having a latching head at an end thereof, wherein the latching head is received in a latching groove in the mandrel when the anchor seat is in the anchoring position.

25. The tool of claim 21, the anchor seat groove profile comprising substantially square grooves with crowns therebetween.

26. The tool of claim 21, the packer comprising an inflation packer, the cementing port communicated with an inflation passageway to inflate the packer when the opening sleeve is in the open position.

27. A downhole tool for use in a well comprising:

a mandrel connectable in a pipe string to be lowered into the well;

a sleeve movable axially in the mandrel;

an elastically deformable anchor seat inserted into the mandrel to an anchoring position in the mandrel, wherein the anchor seat will prevent the movement of the sleeve in one axial direction in the mandrel when the sleeve is engaged with the mandrel and wherein the anchor seat is radially compressed during insertion into the anchor seal, and expands radially to a relaxed condition upon full insertion into the anchor seat and a retainer insertable into the deformable anchor seat to hold the anchor seat in the anchoring position; and wherein the sleeve comprising a sliding sleeve detachably connected in the mandrel in a closed position, and positioned to cover a port through which fluid may be communicated when the sliding sleeve moves from the closed to an open position, and wherein the anchor seat will stop the movement of the sliding sleeve in the mandrel.

* * * * *